United States Patent [19]

Kunin

[11] 3,997,060

[45] Dec. 14, 1976

[54] DISPLAY ASSEMBLY

[75] Inventor: Seymour L. Kunin, Paxton, Mass.

[73] Assignee: S.H. Kunin Felt Co., Inc., Worcester, Mass.

[22] Filed: July 14, 1975

[21] Appl. No.: 595,611

Related U.S. Application Data

[63] Continuation of Ser. No. 390,900, Aug. 23, 1973, abandoned.

[52] U.S. Cl. ..... 211/126; 211/133; 211/181

[51] Int. Cl.[2] ..... A47F 5/01

[58] Field of Search ..... 211/49 R, 49 D, 73, 211/126, 128, 133, 181; 312/260, 261, 126, 330, 286, 287; 206/72, 73; 229/34 R

[56] References Cited

UNITED STATES PATENTS

| | | | |
|---|---|---|---|
| 464,723 | 12/1891 | Pope | 211/181 X |
| 2,229,425 | 1/1941 | Tanner | 229/34 R |
| 2,590,732 | 3/1952 | Simancik | 206/72 X |
| 2,891,677 | 6/1959 | Ritchie | 211/49 |
| 2,926,022 | 2/1960 | Nau et al. | 211/133 X |
| 3,184,075 | 5/1965 | Cohen | 211/181 X |
| 3,252,434 | 5/1966 | Young | 211/181 X |
| 3,279,618 | 10/1966 | Bergstedt | 211/49 D |
| 3,490,598 | 1/1970 | Federman | 211/181 X |
| 3,517,825 | 6/1970 | Propst | 211/126 |
| 3,643,808 | 2/1972 | Ryan et al. | 211/49 D |

*Primary Examiner*—Roy D. Frazier
*Assistant Examiner*—Robert W. Gibson, Jr.
*Attorney, Agent, or Firm*—Norman S. Blodgett; Gerry A. Blodgett

[57] ABSTRACT

A display assembly consisting of a rack with a plurality of compartments, trays in the compartments, and stacks of fabric pieces in the trays, all arranged so that the fabric pieces are adequately displayed.

5 Claims, 5 Drawing Figures

DISPLAY ASSEMBLY

This is a continuation of application Ser. No. 360,900 filed Aug. 23, 1973, now abandoned.

BACKGROUND OF THE INVENTION

It is common practice in stores to display for sale various colored pieces of fabric such as felt, which can be used in various kinds of hobbies and home crafts. For instance, decorative pictures can be made by cutting out various colored pieces of felt and fastening them together. Various other household articles and toys can be made from such material.

The displaying of felt pieces in a store presents a number of problems. If the various colors are placed in one stack on a table, the cutomers are forced to handle all of the pieces of felt in order to obtain the particular color they want. If the felt pieces are placed in small stacks, each stack consisting of felt of a single color, the table or counter space necessary to accomplish this (even with a small number of colors) is quite large. Stores are hesitant to devote a large amount of horizontal display surface to a single product to be sold. Furthermore, it is desirable that the felt pieces be displayed in such a way that they will not be handled by the customer. In other words, it is desirable that the customer be able to obtain a particular piece of felt without handling other pieces of felt and subjecting them to wear and discoloration. One way to overcome this problem would consist in placing the felt in individual drawers in a multi-drawer cabinet, but the difficulty would be that the article stored in this way would not be attractive enough to entice a purchaser to buy. In other words, even though some sales may take place to persons who are absolutely sure before they come into the store what they wish to buy, there are no sales on an "impulse" basis. These and other difficulties experienced with the prior art devices have been obviated in a novel manner by the present invention.

It is, therefore, an outstanding object of the invention to provide a display assembly in which stacks of fabric pieces are displayed without occupying more valuable useful space in the retail store than is necessary.

Another object of this invention is the provision of a display assembly for felt pieces having a rack and trays of inexpensive construction so that the manufacturer of the felt pieces can supply the entire assemblage to the retail merchant without cost to the merchant.

A further object of the present invention is the provision of a display assembly for felt pieces in which the various colors of felt are segregated and are available to a purchaser without disturbing other felt pieces.

It is another object of the instant invention to provide a display assembly for felt pieces having a rack and tray construction which is in skeleton form, so that the goods are completely visible and readily available to the purchaser.

A still further object of the invention is the provision of a display assembly for felt pieces, which assembly is made up from readily available inexpensive material, which is light in weight so that it can be suspended from an unoccupied vertical surface in the store, which can be readily loaded by the manufacturer's representative or a store clerk so that the supply of goods is maintained at an adequate level, and in which the display of the goods is such as to stimulate a desire to purchase.

With these and other objects in view, as will be apparent to those skilled in the art, the invention resides in the combination of parts set forth in the specification and covered by the claims appended hereto.

SUMMARY OF THE INVENTION

In general, the invention consists of a display assembly, having a front face provided with a large number of openings or compartments. The plurality of trays are located in the compartments and are individually slidable in and out. Located in each tray is a stack of fabric pieces. Each tray has a generally rectangular front face, which is normally located in the plane of the front face of the rack and which has a substantial notch extending downwardly from a top edge to expose a portion of the said stack to view.

More specifically, the rack is formed of wire elements welded together in vertical, horizontal and transverse positions, so that the stacks of fabric pieces located in the outermost trays are exposed to view. Each tray is open-topped and has a bottom wall, a front wall of the same height as the opening, and side walls which taper rearwardly and downwardly, each side wall being as high as the front wall where it is attached thereto but tapering downwardly at the rear.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
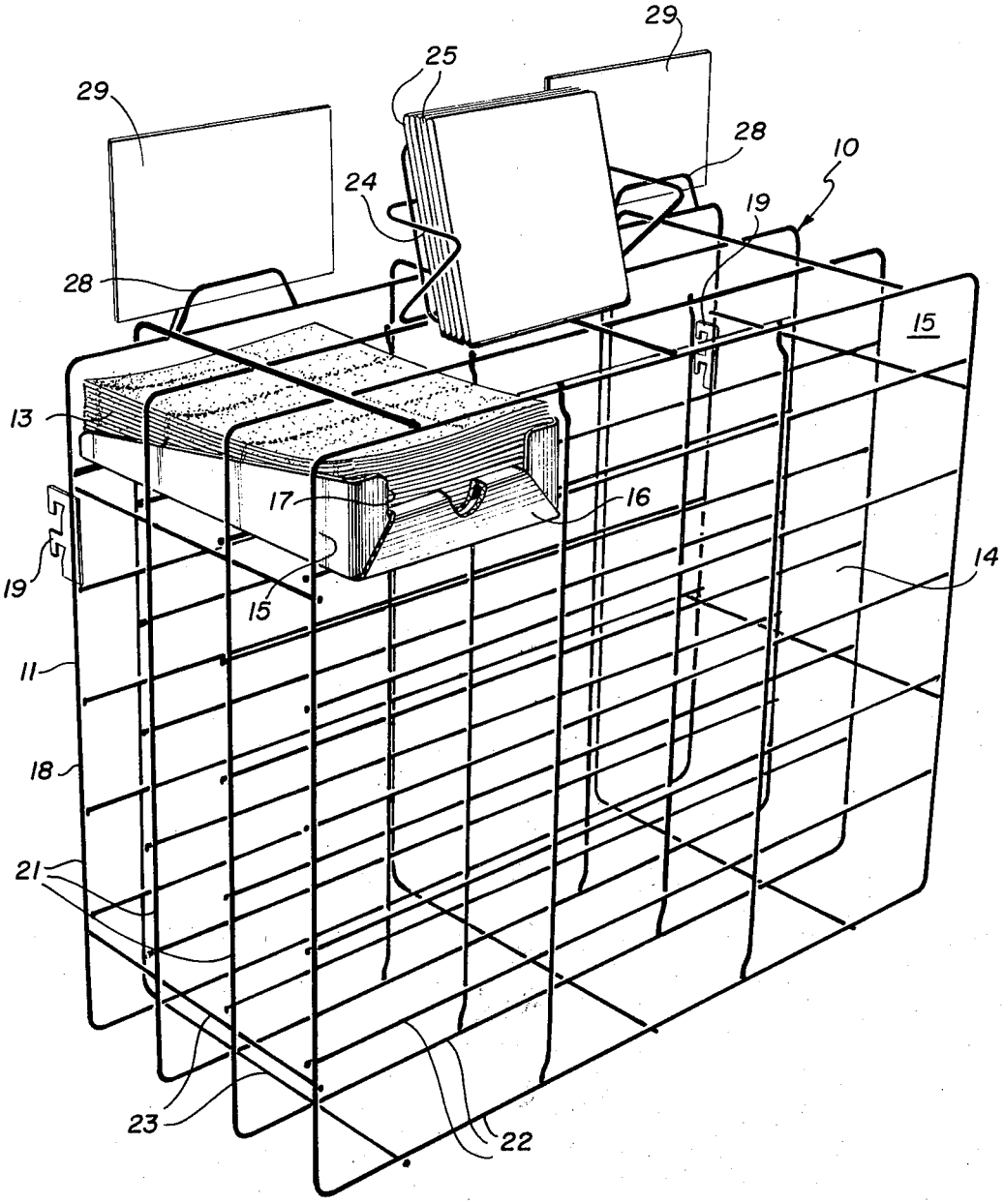
FIG. 1 is a perspective view of a display assembly incorporating the principles of the present invention.

Referring first to FIG. 1, wherein are best shown the general features of the invention, a display assembly, indicated generally by the reference numeral 10, is shown as consisting of a rack 11, a plurality of trays 12, and a plurality of stacks 13 of felt pieces. The rack 11 has a front face 14 provided with a plurality of openings 15, through which the trays 13 may be slid in and out.

Each tray 12 has a front wall 16, which is approximately the same size as the opening 15 in which it resides, there being a substantial notch 17 extending downwardly from the upper edge of the front wall to expose the stack 13 of felt pieces lying in the tray.

The rack 11 has a back surface 18 from either side of which extends brackets 19 in the form of hooks which may be used to suspend the assembly in a convenient place, preferably a vertical surface having a horizontal bar extending across it on which the hooks may be placed. The rack 11 is formed of heavy gage wire welded together to provide vertical elements 21, horizontal elements 22, and transverse (front to rear) elements 23. Each opening 15 on the front face 14 of the rack feeds into a compartment in which rests the tray 12. This compartment is made up of vertical elements 21, horizontal elements 22 and transverse elements 23 in such a way as to particularly support the tray throughout the area of its bottom wall to prevent sagging and to allow sliding in and out through the opening 15 without the tray becoming jammed in the compartment. It is particularly important that sufficient wire elements be provided to support the tray when it extends half way out of the opening, which is the condition it would be in when a customer is removing a fabric piece from the stack 13. The use of wire elements in this way give the rack 11 a skeleton appearance, so that a large number of the stacks 13 in the trays 12 are exposed to view from the front and even from the rear of the rack. Mounted at the top of the rack 11 is a wire holder 24 for retaining a supply of instruction manuals and patterns 25. As is obvious in FIG. 1, wire clips 28 are welded to the top of the rack 11 to hold price tags 29.

Figure 2:
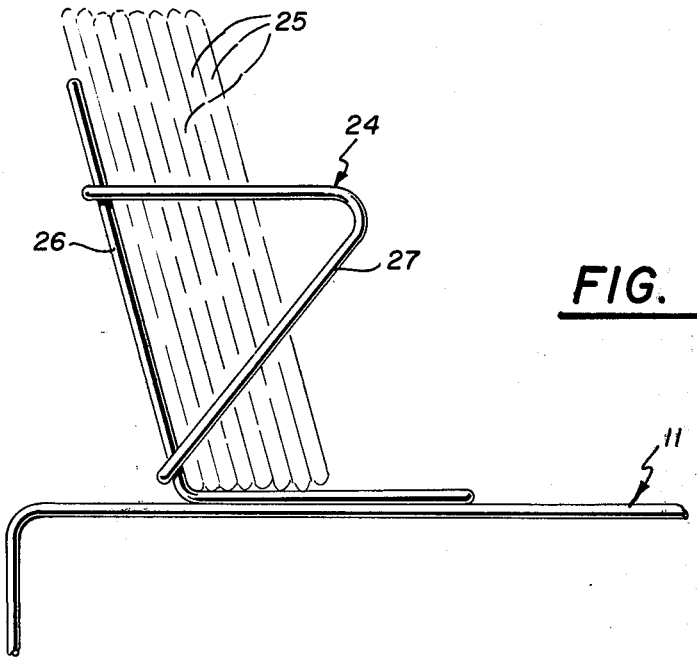
FIG. 2 is an enlarged side view of a portion of the display assembly.

As is obvious in FIG. 2, the wire holder 24 is provided with an inclined back 26 from which extend in a forward direction, two parallel spaced side arms 27 which embrace the patterns 25.

Figure 5:
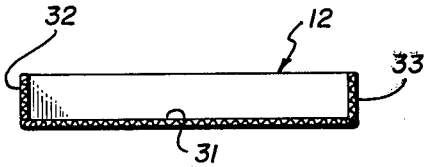
FIG. 5 is a sectional view of the tray taken on the line V—V of FIG. 3.
Figure 3:
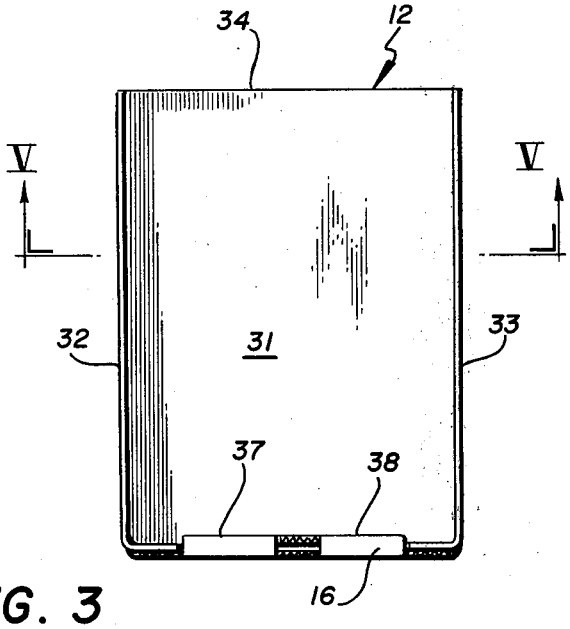
FIG. 3 is a plan view of a tray forming part of the assembly.
Figure 4:
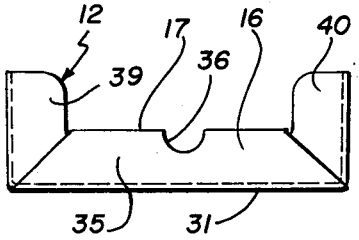
FIG. 4 is a front elevational view of the tray.

FIGS. 3, 4, and 5 show the details of one of the trays 12. The tray is formed of a single sheet of corrugated paper board and has a rectagular bottom wall 31 from the forward edge of which extends the vertical front wall 16, from the side edges of which extend side walls 32 and 33. As has been descirbed previously, these side walls slope downwardly toward the rear, terminating in a very shallow rear wall 34.

The front wall 16 includes a panel 35, which is of trapezoidal shape with its base at the bottom, having a height of only about half the height of the front part of the side walls 32 and 33. Located in the center of the upper edge of the trapezoid is a semi-circular notch 36. Hinged to the top of the panel 34 on either side of the notch 36 are tabs 37 and 38 which extend downwardly relative to and slightly spaced from the panel 34. Hinged to the forward edge of the side walls 32 and 33 are L-shaped tabs 39 and 40. The vertical legs of these L-shaped tabs lie in the plane of the front wall 16 of the tray and form part of that wall. The horizontal inwardly-directed legs are sandwiched between the tab 37 and the panel 34 in the case of the tab 39 and between the tab 38 and the panel 34 in the case of the tab 40. The tabs are glued together in the usual way. The space, therefore, between the upper inwardly-directed edges of the vertical legs of the vertical tabs 39 and 40 and the top edge of the panel 34, including the notch 36, made up the notch 17 which has been mentioned previously and which assists in exposing the contents of the tray.

The advantages of the present invention can now be readily understood. When the rack is hung on a vertical surface, such as the front surface of a counter, so that it extends partly below the top surface of the counter and partly above, it is at such a height that customers can see the goods clearly and have access to almost all of the trays without difficulty. The outer peripheral trays are readily visible through the wire network. It is possible for the sales clerk or the manufacturer's representative easily to maintain the trays full. The display assembly is particularly intended for use with colored felt pieces and it is contemplated that each stock in a given tray be of a single color. The notch 17 on the front of each tray not only makes the nature of the pieces readily apparent from the front of the assembly, but also makes it easy to remove individual pieces. Nevertheless, the trays are able to maintain the individual pieces neatly arranged in the stack, the front edge of each piece contacting the rear surface of the front wall 16. The vertical legs of the tabs 39 and 40 maintain this alignment even in the upper part of the stack. Because the assembly is made up of a welded wire rack and cardboard trays, as well as the goods themselves, it can be seen that it is possible for the manufacturer inexpensively to supply every retailer with the complete assembly. This is not only convenient for the retailer, since he does not have to provide special facilities for the display and sale of the goods, but it enables the manufacturer to ship a good supply and assortment of the goods to the retail store for a first order. Then it is relatively easy to maintain the supply of goods in the rack and trays at a suitable level. There is nothing that discourages a purchaser more than a retail display which lacks, let us say, a certain color of felt piece; it is, therefore, important to have a display in which it is readily apparent when the supply of a certain color or type is running low. Since the compartments extend entirely through the rack from the front wall to the rear wall, many of the compartments are accessible from the rear, depending, of course, upon the manner in which the rack is suspended.

It is obvious that minor changes may be made in the form and construction of the invention without departing from the material spirit thereof. It is not, however, desired to confine the invention to the exact form herein shown and described, but it is desired to include all such as properly come within he scope claimed.

The invention having been thus described, what is claimed as new and desired to secure by Letters Patent is:

1. A display assembly, comprising:

a. a rack having a front face with a plurality of rectangular openings, the rack being formed of wire elements welded together in vertical, horizontal, and transverse positions, b. a plurality of trays located in the rack, each tray being slideable in and out of one of the openings, each tray being open-topped and having a bottom wall, a front wall of the same height as the opening, and side walls which taper rearwardly and downwardly, each side wall being as high as the front wall where it is attached thereon and has little height at the rear, each tray being formed from a sheet of paper board with a rectangular bottom wall, the front wall being formed from a double thickness of board integral with the front edge of the bottom wall, the side walls being provided with the tabs which extend from the front edges of the walls into a space between the two thicknesses of the front wall, and c. a stack of fabric pieces located in each tray, the tray having a generally rectangular front face which is normally located in the plane of the front face of the rack and which has a substantial notch extending downwardly from a top edge to expose a portion of the said stack to view, the rack having rear openings corresponding to and lying opposite the said openings in the front wall, the openings permitting access to the rears of the tray for the replenishing of the stack of fabric pieces.

2. A display assembly as recited in claim 1, wherein a wire holder is welded to the top of the rack to hold a supply of instruction booklets.

3. A display assembly as recited in claim 1, wherein a wire clip is welded to the top of the rack to hold a price card.

4. A display assembly as recited in claim 1, wherein the fabric is colored felt.

5. A display assembly as recited in claim 1, wherein each side wall tab is L-shaped, with the horizontal leg lying within the front thicknesses and the vertical leg forming an upward extension of the front wall and serving as one vertical boundary of the said notch.

* * * * *